United States Patent [19]

Sakurai

[11] Patent Number: 4,638,987

[45] Date of Patent: Jan. 27, 1987

[54] AUTOMATIC DOCUMENT FEEDER

[75] Inventor: Yasuo Sakurai, Atsugi, Japan

[73] Assignee: Ricoh Company, Ltd., Tokyo, Japan

[21] Appl. No.: 809,192

[22] Filed: Dec. 16, 1985

[30] Foreign Application Priority Data

Dec. 20, 1984 [JP] Japan ..... 59-267378

[51] Int. Cl.[4] ..... B65H 7/02

[52] U.S. Cl. ..... 271/111; 271/116; 271/122; 271/902

[58] Field of Search ..... 271/122, 226, 227, 902, 271/110, 111, 116

[56] References Cited

U.S. PATENT DOCUMENTS

| | | | |
|---|---|---|---|
| 3,961,786 | 6/1976 | Yanker | 271/122 |
| 4,496,145 | 1/1985 | Fukui | 271/122 |
| 4,522,385 | 6/1985 | Stefansson | 271/122 X |

*Primary Examiner*—Richard A. Schacher

*Attorney, Agent, or Firm*—Oblon, Fisher, Spivak, McClelland, & Maier

[57] ABSTRACT

An automatic document feeder for use with a facsimile apparatus, a copier or the like includes a separator roller and feed rollers which are mounted on a common shaft and each is provided with a spring clutch. While the separator roller cooperates with a friction roller for separating documents from a stack on a tray one at a time, the feed rollers cooperate one with another feed roller, which is provided with a one-way clutch, for feeding the separated document. A reversible stepping motor is selectively driven in opposite directions depending upon the position of a document in a predetermined path, so that the coactive feed rollers selectively serve as drive rollers and follower rollers. The separator roller rotates in the same direction as the feed rollers which are coaxial therewith only when the latter serves as drive rollers.

8 Claims, 6 Drawing Figures

AUTOMATIC DOCUMENT FEEDER

BACKGROUND OF THE INVENTION

The present invention relates to an automatic document feeder associated with a facsimile apparatus, a copier or like machine for automatically feeding a desired number of documents one by one to a predetermined station inside the machine.

In one type of facsimile apparatuses and others known in the art, a stationary document reader scans a document which is moved along a predetermined path so as to focus the resulting optical data onto a photoelectric transducer, i.e. a charge coupled device (CCD). Document feed in this type of apparatus is generally implemented with a relatively simple automatic document feeder (ADF). A prior art ADF for such an application includes a separator roller and a flat friction member which is pressed against the separator roller, so that documents stacked on a tray are separated one at a time based on the differences in friction between the separator roller, friction member and documents. This prior art ADF, however, is operable only under limited separation conditions partly because the pressure force exerted by the friction member and the coefficient of friction of documents are not always constant. In addition, where a single document is to be fed by such an ADF, the document and the friction member are apt to slip on each other resulting in skew feed or delayed feed of the document. Another prior art ADF which is designed to eliminate the above drawbacks uses a roller in place of the flat friction member and maintains the roller (hereinafter referred to as a document stop roller) in pressing contact with the separator roller. In this kind of prior art ADF, a relationship that the coefficient of friction between documents is greater than that between the document stop roller and the documents which in turn is greater than that between the documents is set up, allowing a stack of documents to be fed sequentially one by one from the bottom of the stack. Where a single document is to be fed, the document stop roller which is in a free state is rotated by the separator roller to successfully deliver the document. However, just as it solves the problems particular to the previously stated flat friction member scheme, it brings about another problem that a solenoid, a clutch and other special mechanisms are needed to prevent two or more documents from being fed continuously and, also, additional rollers for positively driving a separated document are essential, the resulting ADF being bulky and disproportionate in the number of structural elements.

SUMMARY OF THE INVENTION

It is therefore an object of the present invention to provide an ADF which has a simple and small-size construction.

It is another object of the present invention to provide an ADF which separates documents one by one more stably and with greater accuracy than the prior art ADFs.

It is another object of the present invention to provide a generally improved ADF.

An automatic document feeder of the present invention comprises a separator roller and first feed rollers which are mounted coaxially with the separator roller, a friction roller driven by the separator roller when the separator roller is rotated for separating douments stacked on a tray one at a time, second feed rollers mounted coaxially with each other and held in contact one with each of the first feed rollers for feeding a document which has been separated by the separator roller, and a reversible drive source drivably connected to the coaxial separator roller and first feed roller and to the coaxial second feed roller by a gearing.

In accordance with the present invention, an automatic document feeder for use with a facsimile apparatus, a copier or the like includes a separator roller and feed rollers which are mounted on a common shaft and each is provided with a spring clutch. While the separator roller cooperates with a friction roller for separating documents from a stack on a tray one at a time, the feed rollers cooperate one with each of other feed rollers, which is provided with a one-way clutch, for feeding the separated document. A reversible stepping motor is selectively driven in opposite directions depending upon the position of a document in a predetermined path, so that the coactive feed rollers selectively serve as drive rollers and follower rollers.

The above and other objects, features and advantages of the present invention will become more apparent from the following detailed description taken with the accompanying drawings.

DESCRIPTION OF THE PREFERRED EMBODIMENT

While the ADF of the present invention is susceptible of numerous physical embodiments, depending upon the environment and requirements of use, a substantial number of the herein shown and described embodiment have been made, tested and used, and all have performed in an eminently satisfactory manner.

To better understand the present invention, a brief reference will be made to two examples of prior art ADFs, shown in Figs. 1–3.

Figure 1:
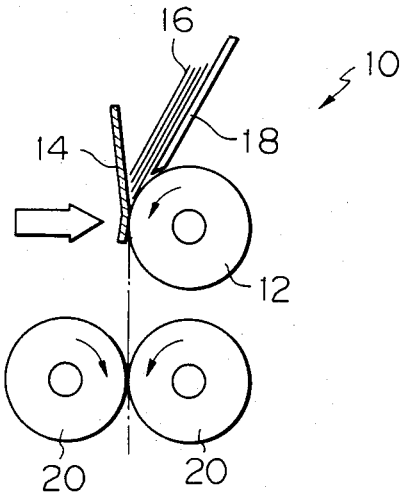
Fig. 1 PRIOR ART
FIG. 1 is a schematic fragmentary side elevation of a prior art ADF.

Referring to FIG. 1, a prior art ADF, generally 10, includes a separator roller 12 and a flat friction member 14 which is pressed against the separator roller 12. The roller 12 and the friction member 14 constitute a separating section. Documents 16 are stacked on a tray 18 and separated one at a time from the stack based on the difference in friction between the separator roller 12, the friction member 14, and the documents 16. A pair of rollers 20 serve as transfer means which is adapted to drive a document 16 separated from the stack on the tray 18 toward a predetermined downstream station, e.g. a document reading station.

The problem with the prior art ADF 10 described above is that since the pressure force exerted by the flat friction member 14 and the coefficient of friction acting between the documents 16 are not always constant, the ADF 10 is operable only under limited conditions. In addition, where a single document 16 is loaded on the tray 18, the document 16 and the friction member 14 are apt to slip on each other to cause the former to be fed in a skew position or with a delay.

Figure 2:
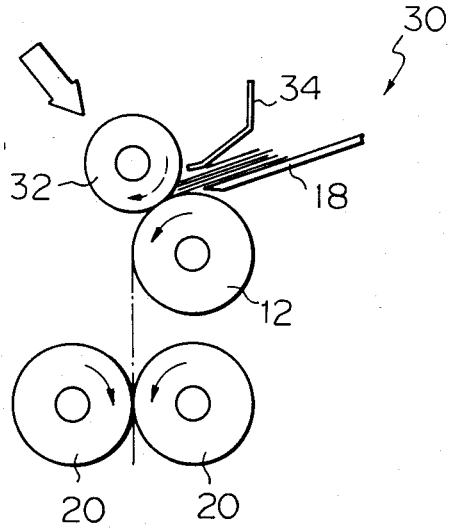
Fig. 2 PRIOR ART
FIG. 2 is a view similar to FIG. 1 but showing another prior art ADF.

Referring to FIG. 2, another prior art ADF which is elaborated to solve such problems is shown. In FIG. 2, the same or similar structural elements as those shown in FIG. 1 are designated by like reference numerals. As shown, the ADF, generally 30 comprises the separator roller 12 and a roller 32 which is pressed against the separator roller 12. The roller 32 replaces the flat friction member 14 of FIG. 1 and will hereinafter be referred to as a document stop roller. A document guide 34 is adapted to guide the documents 16 which are stacked on the tray 18.

Figure 3:
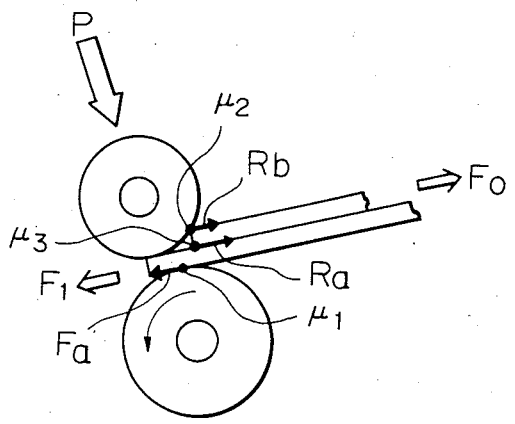
Fig. 3 PRIOR ART
FIG. 3 is a diagram representative of a dynamic environment associated with the ADF of FIG. 2.

Referring to FIG. 3, the principle of document feed particular to the ADF 30 of FIG. 2 is represented in a dynamic relationship. In FIG. 3, $F_1$ is a force which feeds the lowest document 16 out of the stack, P a pressure force exerted by the document stop roller 32, $F_a$ a feed force acting between the separation roller 12 and the document 16 due to the pressure force P, $R_a$ resistance between the documents 16 derived from the pressure force P, $R_b$ resistance between the document 16 and the document stop roller 32 also derived fom the pressure force P, $F_o$ a force which stops the document 16 on the top of the stack, $\mu_1$ a coefficient of friction between the separation roller 12 and the document 16, $\mu_2$ a coefficient friction between the document stop roller 32 and the document 16, and $\mu_3$ a coefficient of friction between the documents 16. Then, there hold the following relations:

$$F_1 = F_a - R_a = P\ (\mu_1 - \mu_3)$$
$$F_o = R_b - R_a = P\ (\mu_2 - \mu_3)$$
$$F_a > R_a$$
$$R_b > R_a$$

Hence, where the number of documents to be fed is one, $$F_1 = F_a - R_b = P\ (\mu_1 - \mu_2)$$
$$F_a \times R_b$$

Therefore, $$\mu_1 > \mu_2 > \mu_3$$

In the above-discussed dynamic environment, where two or more documents 16 are stacked on the tray 18, the document 16 at the bottom of the stack is fed by the friction between the document 16 and the separator roller 12, while the other documents 16 are restrained based on the above relationship. Where only a single document 16 is loaded on the tray 18, the document stop roller 32 is driven by the separation roller 12 partly because the pressure force P is weaker than in the mechanism of FIG. 1 and partly because the roller 32 is in a free state.

With the above principle of operation, the prior art ADF shown in FIG. 3 accommodates a wide range of separation conditions to allow a minimum of slippage between the document and the roller and, thereby, eliminates skew feed and other undesirable occurrences. However, the ADF of FIG. 3 must be furnished with a solenoid, a clutch and other special mechanisms for temporarily stopping the rotation of the roller 12 in order to prevent a document to be fed continuously just after the preceding one. Further, it must be provided with the transfer rollers 20 for positive transport of a separated document 16. Such essential structural elements add to the overall dimensions of the ADF 30 and require a disproportionate number of parts.

Figure 4:
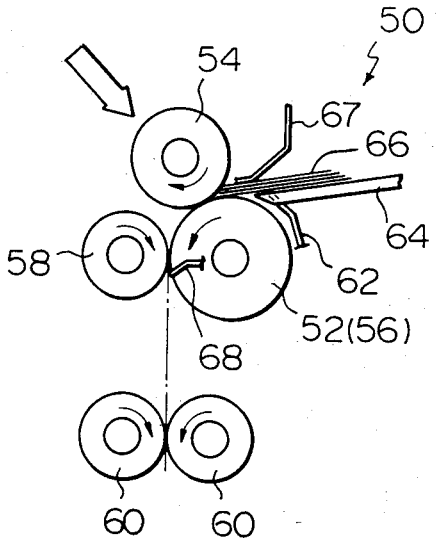
FIG. 4 is a schematic fragmentary side elevation of an ADF embodying the present invention.
Figure 5:
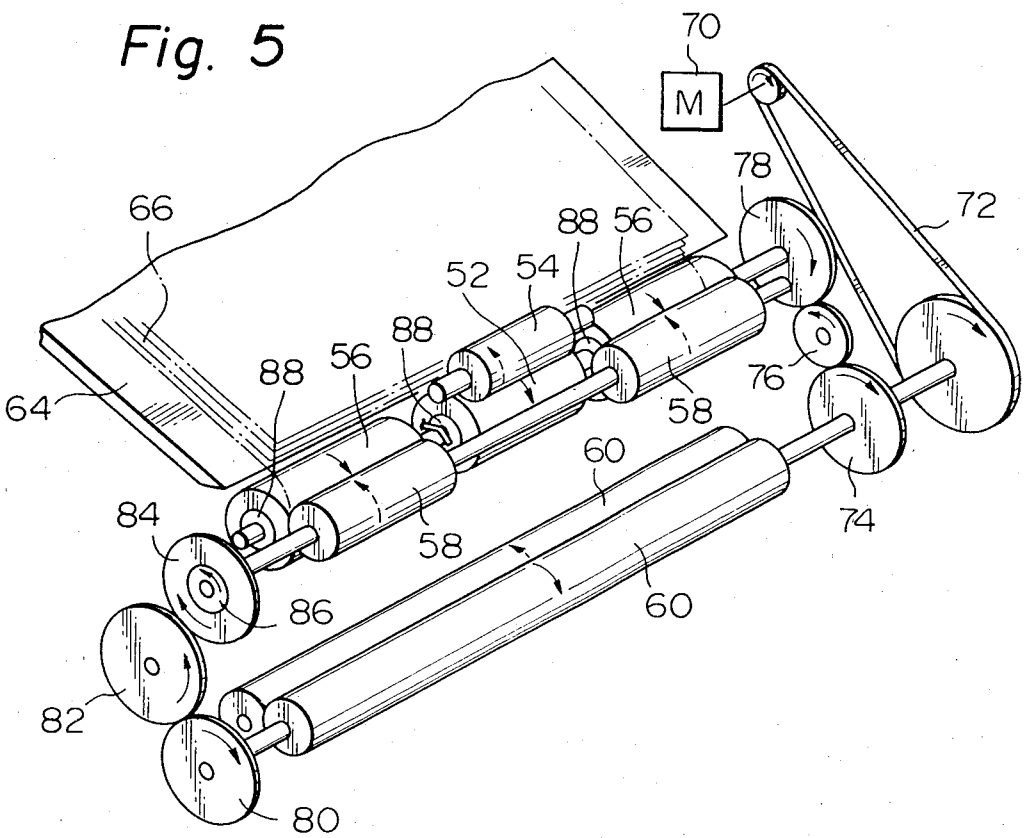
FIG. 5 is a side elevation of the ADF of FIG. 4 in which a stepping motor is rotated in one direction.
Figure 6:
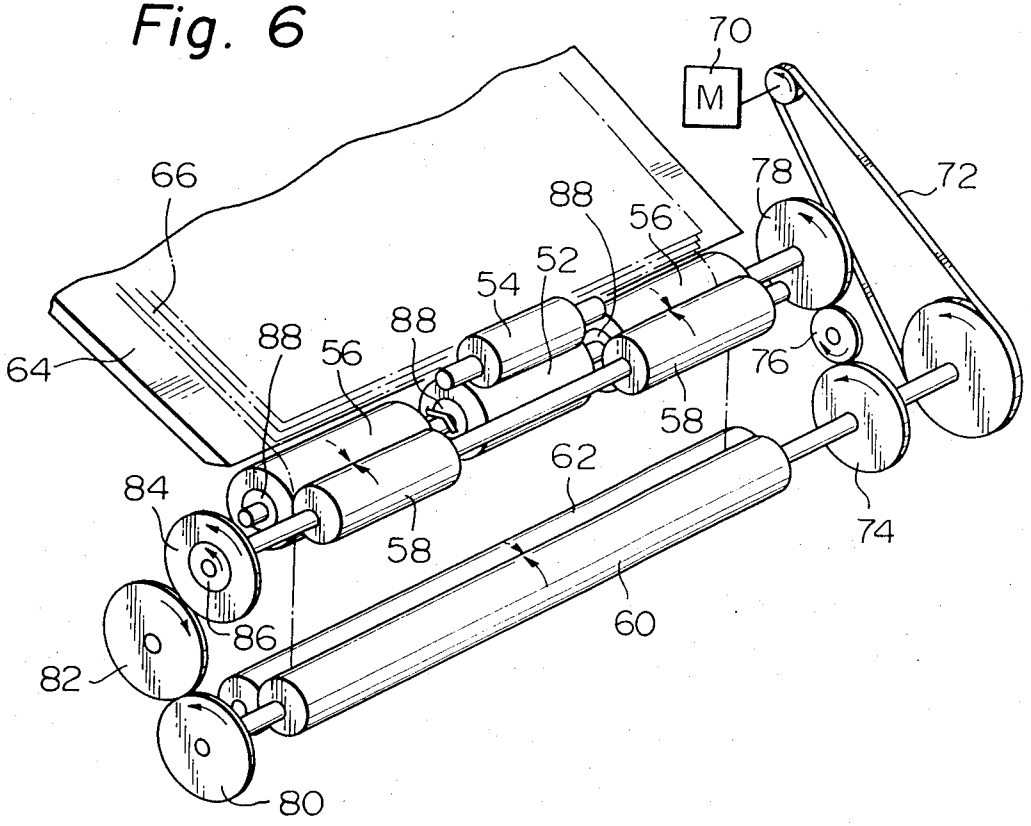
FIG. 6 is a view similar to FIG. 5 but in which the stepping motor is rotated in the other direction.

Referring to FIGS. 4–6, an ADF in accordance with the present invention is schematically shown and generally designated by the reference numeral 50. The ADF 50 includes a separator roller 52 and a friction roller 54 which is held in pressing contact with the separator roller 52 (the roller 54 corresponds to the roller 32). As shown in FIGS. 5 and 6, the separator roller 52 is mounted coaxially with a pair of feed rollers 56, which serve as transfer means. The feed rollers 56 are each in pressing contact with a transfer or feed roller 58. A pair of transfer rollers 60 are located in a predetermined position downstream of the feed rollers 58. A document sensor in the form of a switch 62 is associated with a tray 64 on which a stack of documents 66 are supported. Located in the vicinity of the separator roller 52 is a switch 68 which functions as a sensor for sensing a transfer of a document. All these rollers of the ADF 50 are driven from a reversible stepping motor 70. In FIG. 4, the reference numeral 67 designates a document guide. The operative connection between the rollers and the stepping motor 70 will be understood from the following description of the operation of the ADF 50.

In operation, when the document sensing switch 62 has been turned on, the stepping motor 70 is driven clockwise as indicated by an arrow in FIG. 5. The clockwise rotation of the motor 70 is transmitted by a belt 72 to a gear 74. Then, the gear 74 drives a gear 76 counterclockwise and, thereby, a gear 78 clockwise with the result that the coaxial separator roller 52 and feed rollers 56 are each rotated clockwise as indicated by solid arrows in FIG. 5 (counterclockwise as seen in FIG. 1). In this condition the separator roller 52 separates a document 66 from the bottom of the stack on the tray 64, while the feed rollers 56 feed the separated document 66. Although the clockwise rotation of the gear 74 is imparted by gears 80 and 82 to a gear 84 with which the feed rollers 58 are associated, a one-way clutch 86 intervening between the gear 84 and the feed rollers 58 prevents the latter from rotating clockwise and, instead, allows them to be driven counterclockwise by their associated feed rollers 56 as indicated by phantom arrows. In the meantime, the friction roller 54 rotates when the number of documents 66 is one and remains non-rotated when it is two or more, for the reasons which have been described in relation to the prior art ADF 30 of FIG. 2.

As soon as the switch 68 is turned on by the document 66 which has been separated and transported in the above-described manner, the stepping motor 70 is rotated counterclockwise this time, as indicated by an arrow in FIG. 6. The counterclockwise rotation is transmitted by the gears 74, 80 and 82 to the gear 84 so that the one-way clutch 86 is rotated counterclockwise (clockwise as seen in FIG. 4). Then, the feed rollers 58 are driven counterclockwise as indicated by solid arrows in FIG. 6. Meanwhile, although the counterclockwise rotation of the motor 70 is imparted to the gear 78 as well via the gears 74 and 76, spring clutches 88 which respectively are associated with the separator roller 52 and feed rollers 56 prevent their associated rollers from rotating counterclockwise and, instead, allow them to be driven clockwise as indicated by phantom arrows (in FIG. 6) by the feed rollers, or drive rollers, 58. In the meantime, the separator roller 52 is driven by the document 66 which is being fed. At the instant when the document 66 has moved past the feed rollers 56, separator roller 52 and transport transfer 58, the separator roller 52 is stopped to prepare for another document feeding operation.

In summary, it wll be seen that the present invention provides an ADF which cuts down the number of essential structural elements and, thereby, the overall dimensions and, yet, promotes stable and accurate separation of documents.

Various modifications will become possible for those skilled in the art after receiving the teachings of the present disclosure without departing from the scope thereof.

What is claimed is:

1. An automatic document feeder, comprising:

a separator roller and first feed rollers which are mounted coaxially with said separator roller;

a friction roller driven by said separator roller when the separator roller is rotated for separating documents stacked on a tray one at a time;

second feed rollers mounted coaxially with each other and held in contact one with each of the first feed rollers for feeding a document which has been separated by the separator roller;

reversible drive means drivably connected to the coaxial separator roller and first feed rollers and to said coaxial second feed rollers by a gearing; and means responsive to a motion of the reversible drive means in one direction for rotating the separator roller and the first feed rollers in said one direction such that the separator roller drives the friction roller to separate a document and the first feed rollers drive the second feed rollers associated therewith to feed the separated document, and responsive to a motion of the drive means in the other direction for rotating the second feed rollers in said other direction such that the second feed rollers drive the first feed rollers associated therewith to further feed the document with the separator roller driven by the document which is fed by the first and second feed rollers.

2. An automatic document feeder as claimed in claim 1, wherein said means comprises clutch means.

3. An automatic document feeder as claimed in claim 2, wherein said clutch means comprises spring clutches associated one with each of the coaxial separator roller and first feed rollers.

4. An automatic document feeder as claimed in claim 2, wherein the clutch means further comprise a one-way clutch associated with the coaxial second feed rollers.

5. An automatic document feeder as claimed in claim 1, further comprising first sensor means for sensing the documents on the tray, the reversible drive means being moved in said one direction when said first sensor means has sensed the documents.

6. An automatic document feeder as claimed in claim 5, further comprising second sensor means for sensing the separated document arrived at a predetermined position adjacent to the separator roller, the reversible drive means being moved in said other direction when said second sensor means has sensed the document.

7. An automatic document feeder as claimed in claim 1, wherein the reversible drive means comprises a reversible stepping motor.

8. An automatic document feeder, comprising:

a separator roller and first feed rollers which are mounted coaxially with said separator roller;

a friction roller driven by said separator roller when the separator roller is rotated for separating documents stacked on a tray one at a time;

second feed rollers mounted coaxially with each other and held in contact one with each of the first feed rollers for feeding a document which has been separated by the separator roller; and reversible stepping motor drive means drivably connected to the coaxial separator roller and first feed rollers and to said coaxial second feed rollers by a gearing.

* * * * *